United States Patent [19]

Ito et al.

[11] 3,973,735

[45] Aug. 10, 1976

[54] APPARATUS FOR PULVERIZING AND SORTING MUNICIPAL WASTE

[75] Inventors: Kanichi Ito, Yokohama; Yoshio Hirayama, Zushi; Ryoichi Takeuchi, Kamakura; Masao Nomoto, Tokyo, all of Japan

[73] Assignee: Keishin Matsumoto, President of Agency of Industrial Science and Technology, Tokyo, Japan

[22] Filed: Mar. 24, 1975

[21] Appl. No.: 561,651

[30] Foreign Application Priority Data

| | | |
|---|---|---|
| Apr. 1, 1974 | Japan | 48-36741 |
| Apr. 19, 1974 | Japan | 48-44242 |
| Aug. 21, 1974 | Japan | 48-95686 |
| Aug. 23, 1974 | Japan | 48-96701 |

[52] U.S. Cl. ..... 241/73; 241/87; 241/91; 241/163; 241/187; 241/DIG. 38

[51] Int. Cl.[2] ..... B02C 23/16

[58] Field of Search ..... 241/24, 29, 73, 87, 241/91, 161, 162, 163, 187, 191, 55, 56, DIG. 38

[56] References Cited

UNITED STATES PATENTS

| | | | |
|---|---|---|---|
| 911,913 | 2/1909 | Snyder et al. | 241/162 X |
| 1,948,504 | 2/1934 | Borton | 241/87 X |
| 2,834,553 | 5/1958 | Neely | 241/91 X |
| 2,846,153 | 8/1958 | Krogh | 241/91 X |
| 3,061,205 | 10/1962 | Lavallee | 241/24 |
| 3,834,630 | 9/1974 | Nelson | 241/24 X |

*Primary Examiner*—Granville Y. Custer, Jr.
*Attorney, Agent, or Firm*—Wenderoth, Lind & Ponack

[57] ABSTRACT

An apparatus and a method for processing municipal waste with increased processing capacity are provided. The apparatus includes at least a cylindrical screen having ridge projections on the inner surface thereof and a group of beaters mounted on a central shaft extending axially through the cylindrical screen. In carrying out the method, the municipal waste charged into the cylinder receives powerful beating and shearing due to the interaction caused by the relative rotation between the tips of the beaters and the ridge projections thereby remarkably increasing the processing capacity.

16 Claims, 15 Drawing Figures

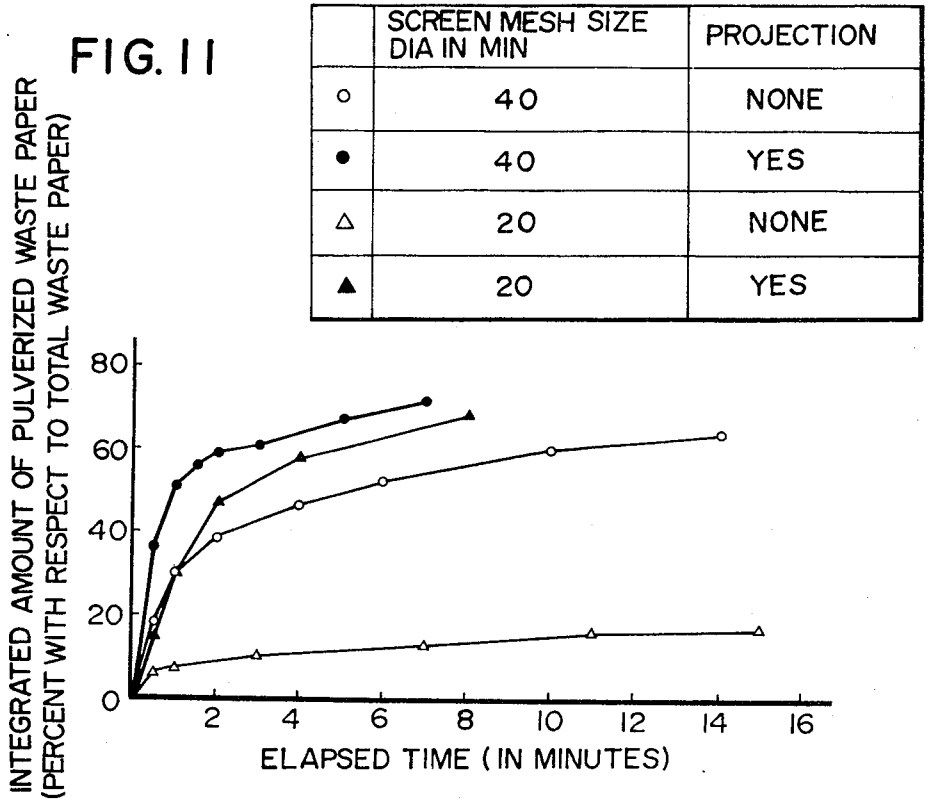
FIG. 11
FIG. 9
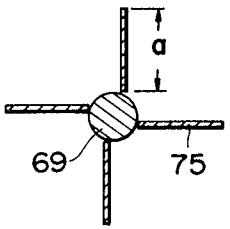
FIG. 10
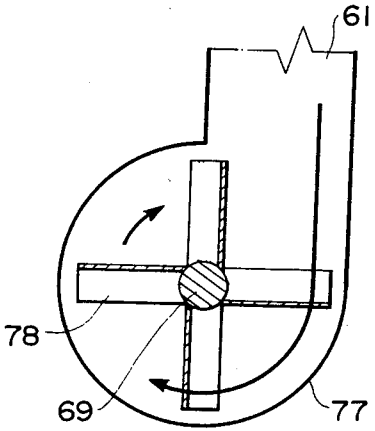

APPARATUS FOR PULVERIZING AND SORTING MUNICIPAL WASTE

CROSS-REFERENCE TO RELATED APPLICATIONS

Reference is made to U.S. Pat. application Ser. No. 464,219 entitled "Method and Apparatus for Recovering Crude Pulp Stock from Municipal Waste" filed on Apr. 25, 1974 in the names of K. Ito and Y. Hirayama, now abandoned and U.S. Pat. application Ser. No. 497,275 entitled "Apparatus for Sorting Waste for Disposal" filed on Aug. 14, 1974 in the names of Y. Hirayama and K. Ito.

FIELD OF INVENTION

The present invention relates to a method and apparatus disposing of waste such as municipal waste and more particularly relates to a method and apparatus for pulverizing municipal waste in a single stage or a plurality of stages and selectively separating or sorting the same.

BACKGROUND OF INVENTION

In order to effectively re-utilize municipal waste, the usual procedure is to segregate the waste so as to recover the re-usable constituents. The rest of the waste is, then, heat-decomposed to generate fuel gas or to obtain liquid fraction and/or is incinerated to utilize heat energy derived thereby. Separation of usable constituents out of waste generally depends on the physical characteristics of the constituents, e.g. magnetism, electrical conductivity, specific gravity, inertia, elasticity, size or the like. Usually, to facilitate the segregating operation, it is deemed necessary to pre-treat the waste by a pulverizer to segregate it to a mono-constituent, respectively and to make the particle size of the pulverized waste uniform.

However, when it is picked up, municipal waste is generally of various kinds, e.g. garbage (food waste such as kitchen refuse), waste paper, scrap wood, waste fibrous material, scrap plastic, glass, and metal and the like. Thus, physical properties of municipal waste are not constant and vary from time to time and from place to place. Therefore it is difficult to reduce such municipal waste into uniform particles by using a conventional pulverizer. Thus, there has been a need for a new and more powerful pulverizer capable of forcibly and uniformly pulverizing the municipal waste by simultaneously applying compression, beat, and shearing. Such a powerful pulverizer has been made, but is unsatisfactory in the points that it is difficult to effectively reduce the waste into uniform particles, it is accomplished by great loss of power and quick wear in the components of the pulverizer, it requires a large amount of electric energy, and maintenance costs are high.

In order to eliminate the disadvantages mentioned above, a pulverizer of a cylindrical rotating cylinder type has been proposed such as for example as disclosed in the cross referenced U.S. Pat. application Nos. 464,219 and 497,275.

These pulverizers proposed in the above co-pending applications work well and effectively pulverize and segregate the municipal waste. However, due to the increase in the amount of the municipal waste to be processed as well as the increasing economical and social demands for recovering useful materials out of the municipal waste, even more efficient pulverization is expected with less loss of power and less maintenance cost.

SUMMARY OF INVENTION

A primary object of the present invention is, therefore, to provide a system for effectively processing municipal waste and recovering usable materials therefrom without the disadvantages or drawbacks of the prior art.

A further object of the present invention is to provide a method and apparatus for processing municipal waste at lower cost with a higher effective recovery of waste for re-utilization, for minimizing environmental pollution and saving man hours.

Another object of the present invention is to provide a method and apparatus for processing municipal waste, said method and apparatus being capable of efficiently pulverizing and segregating the waste in a single unit mechanism.

A further object of the present invention is to provide a system for processing the municipal waste using apparatus which is trouble-free during operation and is easy maintain.

Still another object of the invention is to increase the processing capacity of municipal waste treating apparatus and also to recover a higher proportion of the reusable materials from the waste.

According to the present invention, the objects above are achieved.

The apparatus constructed according to the invention is featured in that it comprises at least a drum in which a cylindrical screen is rotatably housed, said screen being provided with ridge type projections on the inside surface thereof; and size reducing means or beaters disposed inside of said screen so as to oppose said projections and adapted to be rotated independently of the screen. The relative speed between the projections on the inside of the screen and the tips of the beaters is adjusted so that the desired or maximum efficiency in the pulverizing and segregating operation is obtained. As far as the desired relative speed is concerned, the screen may be stationary. Also the proper selection of the mesh size of the screen as well as the dimension of clearance between the projections and the tips of the beaters contributes to increase the efficiency and eliminate the trouble such as clogging of the mesh of the screen.

More specifically, it may be said that the apparatus of the present invention may be adjusted according to the difference in time required for treating each of the waste constituents, the required time being the time required to reduce the specific constituents to a size which will pass the mesh of the screen. The difference in time mainly depends on the physical characteristics of the constituents.

Cylindrical reducing apparatuses somewhat similar to the apparatus of the present invention explained above have previously been proposed, for example, as disclosed in the copending cross-referenced U.S. Pat. application Nos. 464,219 and 497,275 and work well for their intended purposes.

However, there has not been proposed a pulverizer having ridge projections on the inside surface of the screen so as to oppose the rotatable beaters, and our test results prove that the pulverizer of the present invention having ridge projections has a processing capacity up to as much as five times that of the pulverizers having no ridge projection. These ridge projections also serve to effect shearing action on the waste between the tips of the beaters and the projections and to prevent the waste from merely sliding on the inside surface of the screen.

The present invention also provides means for preventing troubles and loss of work time caused by elongated or slender materials such as wire, string, cloth etc. included in the waste. Such materials tend to become entangled on or entangled with moving elements of the apparatus, especially around a rotating shaft, thereby making it necessary to shut down the operation of the apparatus when the amount of waste entangled on or with the element becomes so large that such entangled waste must be removed.

Normally the weakest constituents of the waste such as garbage are pulverized first and pass outside of the screen. It is also possible to arrange the apparatus in a plurality of stages so that a first pulverizer and a second pulverizer are disposed in end-to-end facing relationship and, thus, several constituents of the waste are progressively processed to obtain different reusable materials at different stages.

By performing the method of the present invention employing the apparatus according to the present invention, it is possible to most efficiently pulverize and segregate municipal waste with a minimum of trouble and without need of special supporting resources such as liquid nitrogen, L.N.G. (liquid natural gas) or the like and to efficiently recover the usable materials from the waste thereby improving the recovery rate of reusable materials and the processing capacity.

Also treatment of the respective recovered materials is simplified, because each class of recovered materials includes a minimum of foreign constituents.

Also, due to the increased capacity and efficiency, the cost (apparatus, installation and maintenance) per ton of recovered reusable material is reduced.

The objects and the advantages of the present invention referred to above as well as other objects and advantages will become apparent to those skilled in the art by the detailed explanation of the present invention. The invention now will be described referring to the accompanying drawings, followed by a brief summary thereof.

BRIEF DESCRIPTION OF DRAWINGS

Reference is now made to the drawings wherein

FIG. 9 is a partial cross sectional view taken along the line IX — IX in FIG. 6 and illustrates the arrangement of the anti-entangling means;

FIG. 10 is a cross sectional view taken along the line X—X in FIG. 6;

FIG. 11 illustrates the effectiveness of providing the ridge projections inside the screens;

DETAILED DESCRIPTION OF EMBODIMENTS

Figure 1:
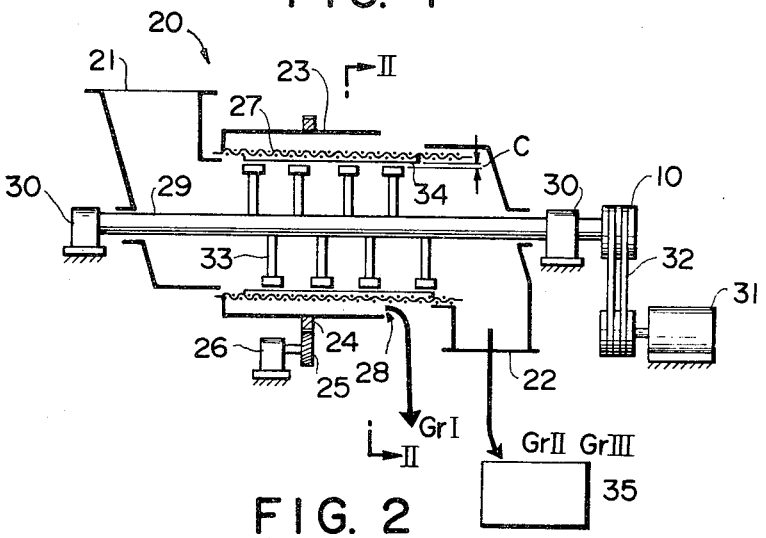
FIG. 1 shows a schematic illustration of a pulverizer of a single stage type according to the present invention.
Figure 2:
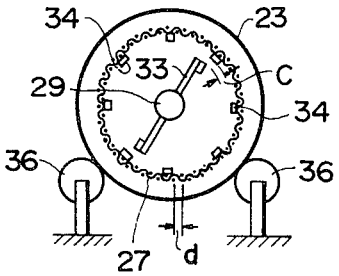
FIG. 2 is a cross section taken along line II—II in FIG. 1.

Referring to the drawings, especially to FIGS. 1 and 2, a pulverizer 20 is shown which is one of the embodiments according to the invention. At one end of the pulverizer 20 a hopper 21 is provided which is adapted to receive municipal waste collected and, at the opposite end, is a discharge opening 22. A drum 23 is interposed between the hopper 21 and the discharge opening 22. This drum 23 is provided with a ring gear 24 on the outer surface thereof and is adapted to be rotatably driven through a pinion 25 which is driven by a motor 26. The drum may be rotatably supported by any suitable means, for example, the supporting rollers 36 shown in FIG. 2. Within the drum 23, a cylindrical screen 27 is disposed coaxially with the drum 23 and is interconnected with the drum so as to be rotated therewith. There is a spacing between the drum 23 and the screen 27 so as to provide a discharge opening 28 at the end of the drum 23 which is on the far side from the hopper 21. Also provided is a shaft 29 extending through the drum and being rotatably supported at opposite ends by a suitable bearing means 30. The shaft 29 is driven by a suitable driving means, for example, a motor 31 and a power transmitting means such as pulleys provided both at one end of the shaft 29 and at the output shaft of the motor 31 and a belt or belts 32 connecting both pulleys. On the shaft 29, a plurality of beaters or blades 33 are arranged radially as shown in FIG. 2 and axially as shown in FIG. 1. Although the radial arrangement of the blades 33 in FIG. 2 is illustrated as diametrically opposing and symmetrical, any other arrangement is available as practiced in the mechanical design, provided that the dynamic balance is maintained. Also, the number of blades is optional and can be adjusted as required.

Inside of the cylindrical screen 27, a plurality of ridge projections 34 are mounted so as to oppose the tips of the beating blades 33 with a clearance therebetween so that the relative rotation of the screen, that is the ridge projections 34 and the beating blades 33, causes no interference during the operation of the apparatus. The ridge projections 34 may be arranged in a manner such that they are parallel to the axis of the cylindrical drum 23, or inclined to the axis above or in a spiral so as to assist advancement of the waste received therein and/or to avoid entanglement of textile to the projections upon rotation of the screen. In FIGS. 1 and 2, the clearance between the tips of the beating blades 33 and the ridge projections 34 is identified as "*c*". This clearance will be further discussed later.

The axis of the drum 23 may be disposed horizontally or canted slightly to the horizon. In case the axis is horizontal, the waste is advanced towards the discharge openings 22 and 28 in the drum by means of the rotating projections 34 and beating blades 33 and, in case the drum is canted, the waste is naturally advanced by gravity. Both advancing effects may be optionally combined.

Since the driving sources for the drum 23 and the shaft 29 are different, namely motors 26 and 31, the relative rotational speed between the tips of the beating blades 34 and the screen 27 (with ridge projections 34) can be varied so as to achieve high efficiency in operation.

Also, the configuration of the drum is illustrated as cylindrical; it may, however, be designed to be frustoconical and the dimension or size of the inside elements may be arranged to agree with the conical shape.

For convenience in the explanation, the pulverized wastes are classified as follows throughout the specification.

Gr I: constituents having the lowest resistance to shock or impact; this group is comprised mostly of garbage, glass, ceramics and rubbish.

Gr. II: constituents having an intermediate resistance to impact; this group comprises most part of waste paper.

Gr. III: constituents having the greatest resistance to impact; this group may be further divided into two groups namely Gr. III*a* and Gr. III*b*.

Gr. III*a* is made up of metallic constituents and Gr. III*b* is made up of other remaining constituents such as plastics, textile, chips of wood, rubber and leather, etc.

The pulverizer 20 effectively treats the municipal waste which comprises the constituents corresponding to Gr. I, Gr. II and Gr. III. Such municipal waste, when it is charged into the hopper 21, constituents belonging to Gr. I are at first selectively pulverized by the shearing and beating effect applied on the waste by the ridge projections and beating blades and the mixing and agitating effect by the beating blades. Thus, the waste belonging to Gr. I is selectively pulverized and passed through the screen 27 into the space between the screen and drum and is discharged outwardly from the opening 28. The remaining constituents belonging to Gr. II and Gr. III are discharged from the opening 22. Most of the garbage having a tendency to be originally accompanied with waste paper contained in Gr. II is segregated as Gr. I and discharged, so it is convenient to recover waste paper as crude pulp stock from the remaining Gr. II and Gr. III constituents, for example, by charging them into a hydrapulper 35 such as disclosed in U.S. Pat. No. 3,549,092 wherein the constituents, reusable as crude pulp stock, are separated from the rest and recovered for re-utilization.

In the illustrated embodiment in FIGS. 1 and 2, it is explained that a drum 23 is preferably rotatable together with the screen 27; but it is also possible to make the whole drum or a part of the drum stationary and to rotate the cylindrical screen independently from the stationary drum or any stationary portion of the drum.

Figure 3:
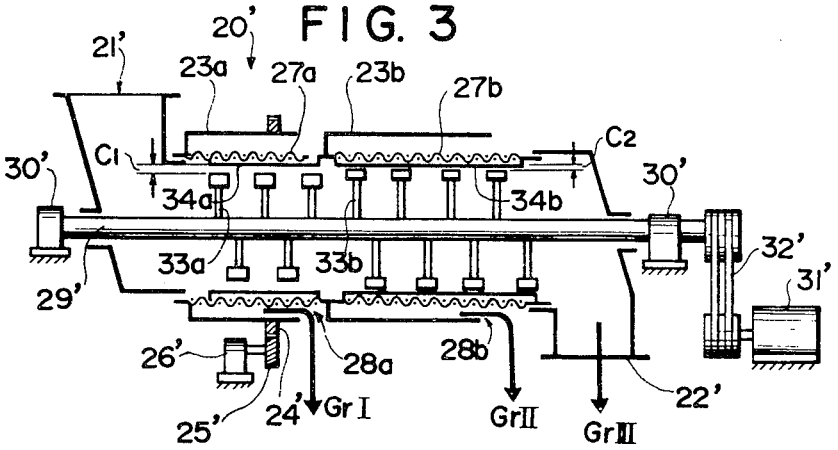
FIG. 3 is a schematic illustration of two stage type pulverizer according to the present invention.

In FIG. 3, another embodiment of the present invention is illustrated. In this embodiment, since most of the components thereof are similar to those in the first embodiment, same reference numbers are assigned to the elements corresponding to those in the first embodiment with prime(') added respectively for the components substantially the same as those of the first embodiment and additional references "*a*" and "*b*" to those similar to those of the first embodiment. As readily seen from FIG. 3, a pulverizer 20'of this embodiment is constructed to have two stages, namely a first drum **23*a* and a second drum 23*b*. Within the first drum 23*a*, in a manner similar to FIG. 1, a cylindrical screen 27*a* having ridge projections 34*a* therearound are disposed along with and a plurality of beating blades 33*a* mounted on a rotatable shaft 29'. Also, the arrangement of a cylindrical screen 27*b*, ridge projections 34*b* on the inner surface of the screen 27*b* and a plurality of beating blades 34*b* with respect to the second drum 23*b* is similar to that in the first stage. Of course, the first and second screens may be directly connected with each other or indirectly connected with each other by a suitable means such as a coaxial stationary or rotatable cylinder conducting to both of the screens. In this pulverizer, a first discharge opening 28*a* is provided at one end of the first drum 23*a*; a second discharge opening 28*b* is provided at one end of the second drum 23*b*; and a third discharge opening 22' is provided at the terminal end of the pulverizer. When the screens 27*a* and 27*b* and the beating blades 33*a* and 33*b* are rotated so as to create relative speed between the tips of the blades and the ridge projections 34*a* and 34*b*, the constituents of the municipal waste are processed so that the Gr. I constituents are selectively pulverized in the first stage and discharged from the first discharge opening 28*a*. The Gr. II constituents are selectively pulverized in the second stage and discharged from the second discharge opening 28*b*, and the remaining Gr. III constituents are discharged from the third discharge opening 22'**.

Figure 4:
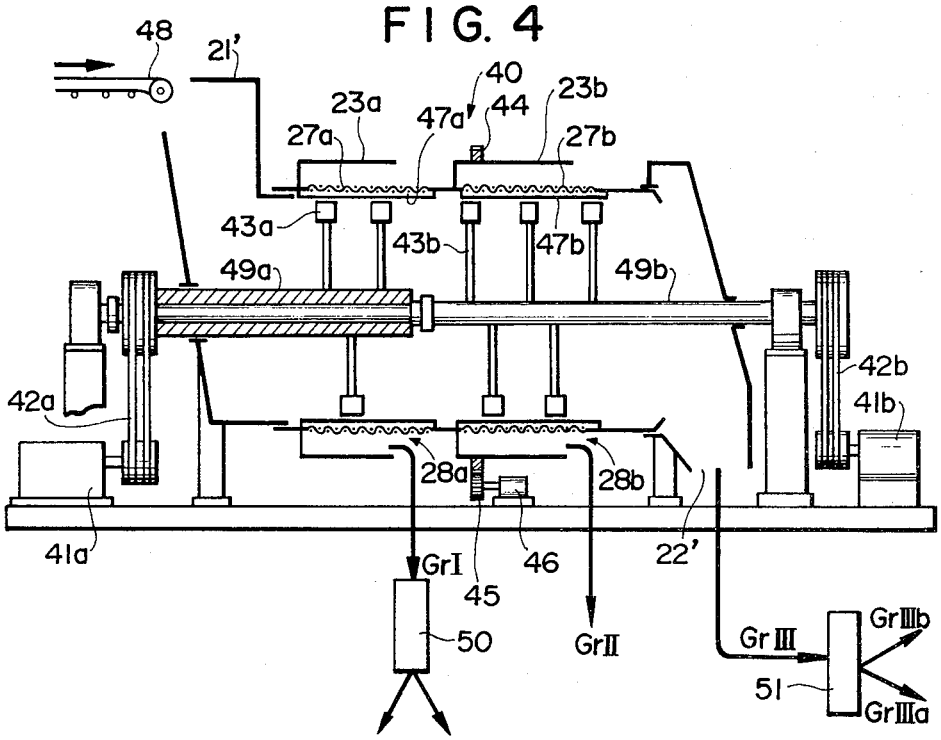
FIG. 4 is an alternate embodiment of a two stage type.

In FIG. 4, another embodiment of the present invention is illustrated which is a modification of the second embodiment. The parts similar to those in FIG. 3 are assigned the same references on in FIG. 3. A pulverizer 40 of this embodiment also comprises two stages, namely the portions corresponding to a first drum **23*a* and a second drum 23*b*. In this embodiment, a central shaft extending through the pulverizer is divided into two parts, namely a first part shaft 49*a* and a second part shaft 49*b*. The first 49*a* has mounted thereon a plurality of beating blades 43*a* so that the respective tips of the blades oppose the ridge projections 47*a* with a proper clearance therebetween. Also, the mutual relationship in the second stage between the second shaft 49*b*, the beating blades 43*b* and the ridge projections 47*b* is similar to that in the first stage. An inner end of the first shaft is arranged to be a hollow and serves as a bearing to rotatably receive an inner end of the second shaft 49*b* which is coaxial with the shaft 49*a*. At the respective opposite ends, the first and second shafts 49*a* and 49*b* are suitably journaled by suitable bearing means and are adapted to be driven though motors 41*a* and 41*b* and belts 42*a* and 42*b*, respectively. Since the respective driving sources 41*a* and 41*b* are independent of each other, the rotational speeds of the shafts 49*a* and 49*b* may be arranged to be different so as to provide a wide variety in selection of the respective rotational speeds, i.e. the circumferential speed of the respective tips of the beating blades 43*a* and 43*b*. A motor 46 is disposed at suitable position and is provided with a pinion 45 on its extended shaft, the pinion 45 being adapted to rotate the first and second drums 23*a* and 23*b* in unison through a ring gear 44 mounted on the outside of the drum 23*a* or 23*b*, thereby also rotating the first and second screens 27*a* and 27*b*** in unison.

It is, of course, optional to provide a conveyor 48 beside the hopper 21' for charging municipal waste into the hopper 21'.

In a way similar to the operation discussed in the explanation of the second embodiment, Gr. I, Gr. II and Gr. III are discharged out of the openings 28*a*, 28*b* and 22', respectively.

In case further sorting of the respective groups of constituents thus segregated above is required, the pulverized and discharged waste is forwarded to the next sorting process, for example, Gr. I is forwarded to a grader 50, and Gr. III is forwarded to a grader 51 where Gr. III is further sorted into Gr. III*a* and Gr. III*b* by utilizing certain features, such as the difference in specific gravity, of the respective constituents.

Although the embodiment in FIG. 4 is illustrated so as to have two independent driving sources for the divided shafts 49*a* and 49*b*, one of the driving sources may be eliminated if an appropriate differential coupling is employed between the first and second shafts 49*a* and 49*b*. Also, if the first and second screens 27*a*, 27*b* and drums 23*a*, 23*b* are not coupled so as to be driven in unison, they may be driven is unison by, for example, by providing a pinion and a ring gear on the extension of the motor shaft and on the outerside of the drum 23*a*, respectively.

Also, it is possible to arrange for one or two of the drums 23*a*, 23*b* and the screens 27*a*, 27*b* to be stationary so as to provide versatility in the selection of the relative speeds.

Further, it is also possible to devise the relationship between the first and second stages so that the first drum 23*a* with the first screen 27*a* is independently driven from the rotation of the second drum 23*b* and the second screen 27*a*. This easily accomplished by providing another motor similar to the motor 46.

Figure 5:
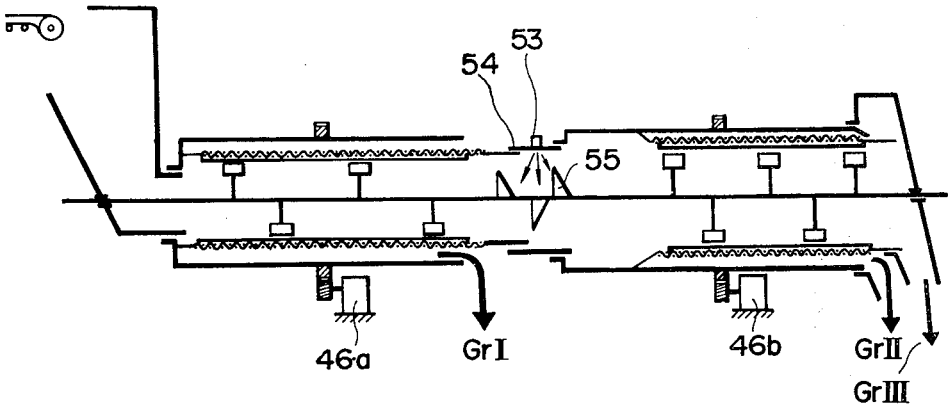
FIG. 5 illustrates a mode of possible modification of the two stage type pulverizer shown in FIGS. 3 and 4.

In FIG. 5, there is schematically illustrated a pulverizer of a two-stage type which resembles the last mentioned mode of working, namely the first and second stages are provided with independent motors 46*a* and 46*b*, respectively. This drawing also explains the possibility of providing a water spray means and a waste advancing means, as required, at appropriate positions. As illustrated, a water spray nozzle 53 may be disposed at a stationary cylinder 54 communicating with the second stage. These nozzles are for spraying water on the waste received so as to weaken the strength of the constituents which tend to be weakened by absorption of water. The provision of the nozzle at the entrance of the second stage is especially effective since the waste paper included within Gr. II is remarkably weakened by absorption of moisture thereby increasing the recovery rate of crude pulp stock. Also, advancing blades 55 may be mounted on the central shaft between the first and second stages to promote the advancement of the waste.

Figure 6:
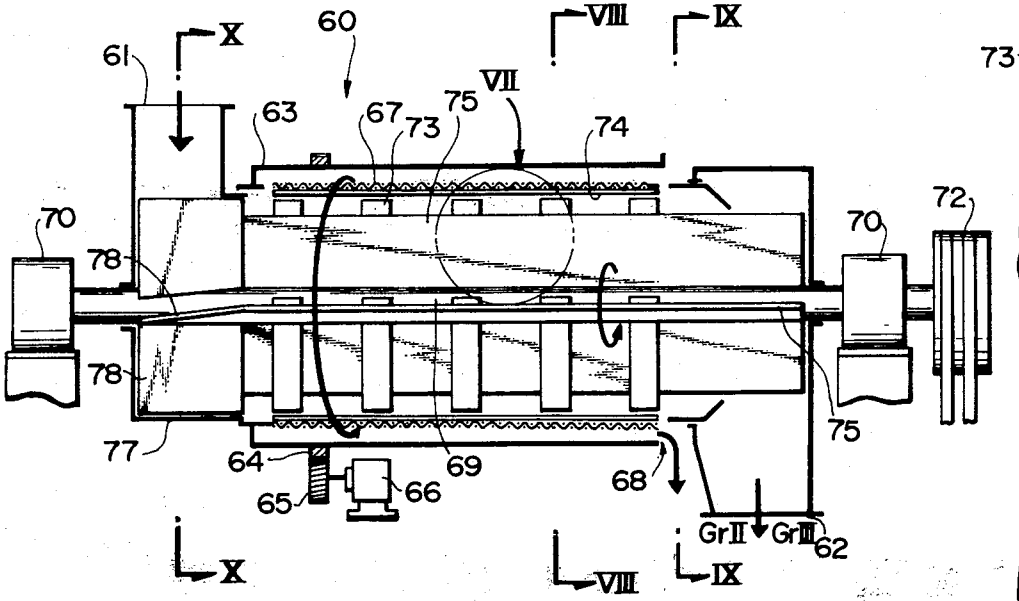
FIG. 6 is also another embodiment of a single stage pulverizer incorporating an anti-entangling means.

In FIGS. 6 thru. 10, another embodiment of the present invention is illustrated as a pulverizer 60 which incorporates a means for avoiding entanglement of the constituents of the waste, such as wires, strings textile and fibrous materials, etc., with the components of the apparatus, especially the rotating shaft.

In the pulverizer 60, similar to the embodiments already explained above, disposed therein are: a hopper 61, a discharge opening 62 for Gr. II and Gr. III, a drum 63, a ring gear 64, a pinion 65, a motor 66, a cylindrical screen 67, a discharge opening 68 for Gr. I, a main shaft 69, bearing means 70, a belt means 72, a plurality of beating blades 73 mounted on the main shaft 69, and ridge projections 74. Each function of the above-listed items is substantially similar to that illustrated in FIG. 1 when the respective reference numerals having 61 – 69 and 70 – 74 in FIG. 7 are replaced with numerals having 21 – 29 and 30 – 34, respectively.

Figure 8:
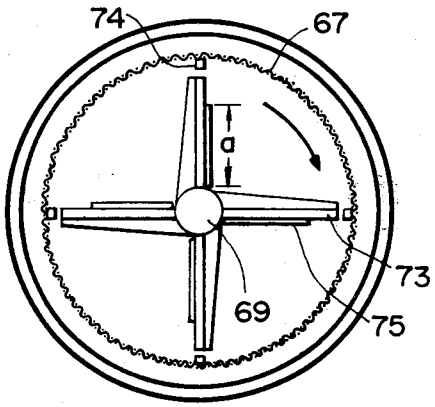
FIG. 8 is a cross sectional view taken along the line VIII — VIII in FIG. 6.

In addition to those components referred to above, anti-entangling plates 75 are disposed around the shaft 69, as shown, so as to extend axially from the portion near the hopper 61 and to the opposite end of the drum near the discharge opening 62. The anti-entangling plates 75 are also mounted on the shaft radially as shown in FIG. 8, preferably on the front side of the beating blades 73 with respect to the rotational direction indicated by an arrow in FIG. 8.

Figure 7:
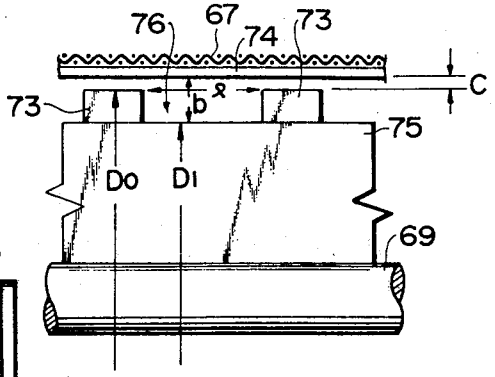
FIG. 7 is an enlarged view of a portion corresponding to the circle VII in FIG. 6.

As shown in FIG. 7 which is an enlarged view of the fractional part VII in FIG. 6, the diameter $D_1$ of the anti-entangling plates 75 is arranged to be smaller than the diameter $D_0$ of the beating blades 73 so as to provide a passage 76 for the waste, the passage 76 being defined by the opposing edges of the adjacent blades 73 spaced apart a distance "*l*", corresponding to the outer edge of the anti-entangling plate 75 and the inner edge of the ridge projection 74.

As in FIG. 1, the clearance between the tips of the beating blades 73 and the ridge projection 74 is defined by "*c*" in FIG. 7. Also, the spacing between the outer edge of the anti-entangling plate 75 and the inner edge of the ridge projection 74 is referenced as "*b*" in FIG. 7 and the width of the plate 75 is given reference "*a*". These will be further discussed later.

The waste charged into the pulverizer is pulverized between the respective opposing edges of the ridge projections 74 and the tips of the beating blades 73; however, the constituents such as metals and other high-tenacity constituents will be flipped before getting into the clearance identified "*c*" and directed to the passage 76, thereby eliminating the increase of necessary power, noise and vibration to achieve smooth operation of the apparatus.

There is a cylindrical stationary drum 77 disposed as an extension of the drum 63 so as to allow relative rotation of the drum 63 with respect to the stationary drum 77.

One edge of the chute constituting the lower part of the hopper 61 is arranged to be tangential to the periphery of the drum 77 as shown in FIG. 10 and, within the drum 77, a suitable number of advancing blades 78 are mounted on the main shaft 69. The tangent continuation above is aligned in the direction of the rotation of the advancing blades 78 as indicated in FIG. 10, thereby facilitating the transfer of the waste and effectively preventing the wet constituents from clogging the apparatus. The advancing blades 78 may be canted with respect to the main axis as schematically illustrated in FIGS. 6 and 10 so as to effectively advance the waste towards the right as seen in FIG. 6.

Although the pulverizer 60 is illustrated as a single stage apparatus, modifications similar to those in FIGS. 3, 4 and 5 are, of course, available to provide a plurality of processing stages.

By providing the anti-entangling plates 75 such as illustrated, the shaft and/or the sleeve couplings and distance pieces usually fixed or secured to the shaft are not exposed in a complete cylindrical configuration as illustrated in FIGS. 7 and 8 and, thus, the constituents of the waste such as elongated materials tending to be entangled with or on the rotating member are effectively prevented from winding around the shaft.

It was proved, according to a long running test, that nonentanglement was found when the width "a" of the anti-entangling plates 75 was above 150 mm. Further, as a secondary effect of providing the plates 75, the processing capacity of the pulverizer is also increased, especially when the rotational speed of the beating blades is low in the small pulverizers, without affecting the sorting efficiency and equalizing efficiency. In one instance, the capacity was increased as much as twice that of the pulverizer having no anti-entangling plate.

It was noted in FIG. 7 that the following range of dimensions was found to be practical and superior to achieve the smooth operation.

$b = 100 - 400$ mm
$l = 100 - 400$ mm.

With respect to the ridge projections in the embodiments explained, it was found that the provision of the ridge projections in the present invention is mandatory to achieve satisfactory effects and advantages, especially with respect to the capacity of the pulverizer. To prove the effects of the ridge projections, tests were conducted with two pulverizers, one provided with ridge projections and the other without, both being the same except for the ridge portions. The test result is given in FIG. 11. As is readily noted from this drawing, the capacity of the pulverizer having the ridge projections is remarkably high in comparison to that having no projections.

With respect to the beating blades or beaters, it is noted that these beaters effectively serve to agitate, shear and pulverize the waste received in the pulverizer in combination with the ridge projections as well as to provide cleaning of the screen surface. The beaters are preferably constructed in plate form of rigid material; however, they may be made in a knife shape, chain, rod or wire or with flexible ones made of rubber or leather, etc.

To further explain the effect and/or the advantage of the present invention, some numerical data are given with respect to the clearance, mesh size of the screen and the relative rotational speed; however, it should be noted that the present invention is not limited in any way by such numerical values.

It was found that, for all of the embodiments, the screen mesh size is preferably in the range of 20 – 45 mm in diameter, assuming that the perforation is a circle; however, any shape of perforation may be selected. In this specification, when the diameter of the mesh size is referred to, it should be assumed to refer to one either in a circular perforation or a perforation whose area is equivalent to a circle having such diameter.

If the diameter is expressed by "$d$", the clearance "$c$" noted in FIGS. 1, 2 and 7 is preferably, especially in case for recovering waste paper as crude pulp stock, in the range defined by the relation:

$c < 0.7d$
$(d = 20 - 45$ mm$)$

Figure 12:
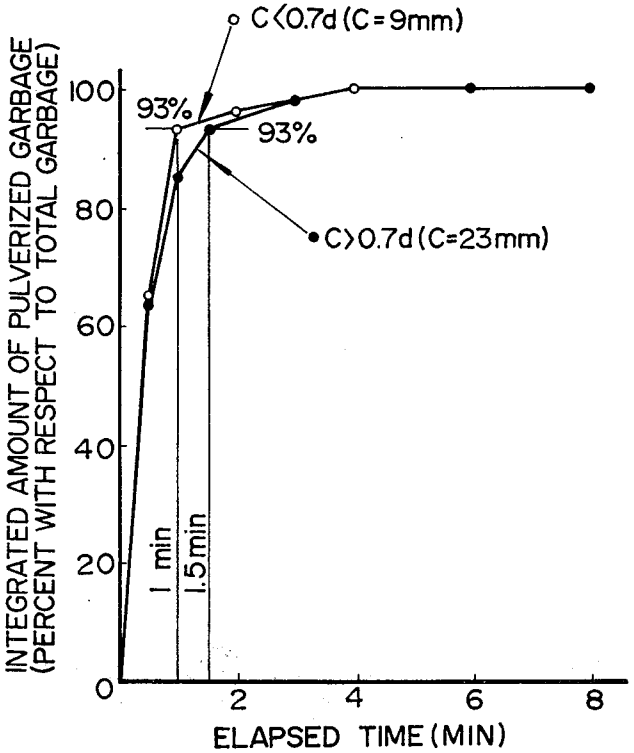
FIGS. 12 and 13 illustrate the integrated amount of pulverized waste in comparison to the elapsed time for varying distances "*c*" between the beaters and the projections.
Figure 13:
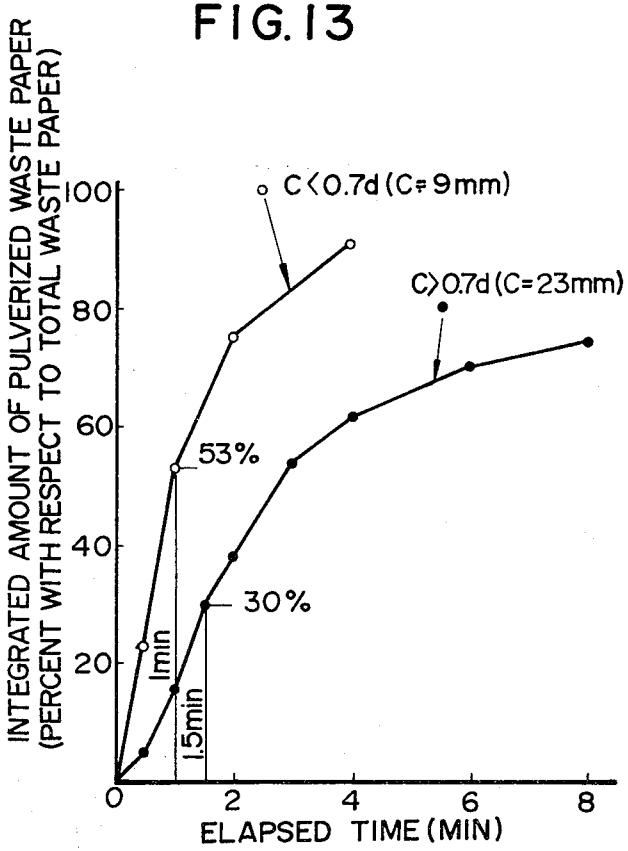
Figure 14:
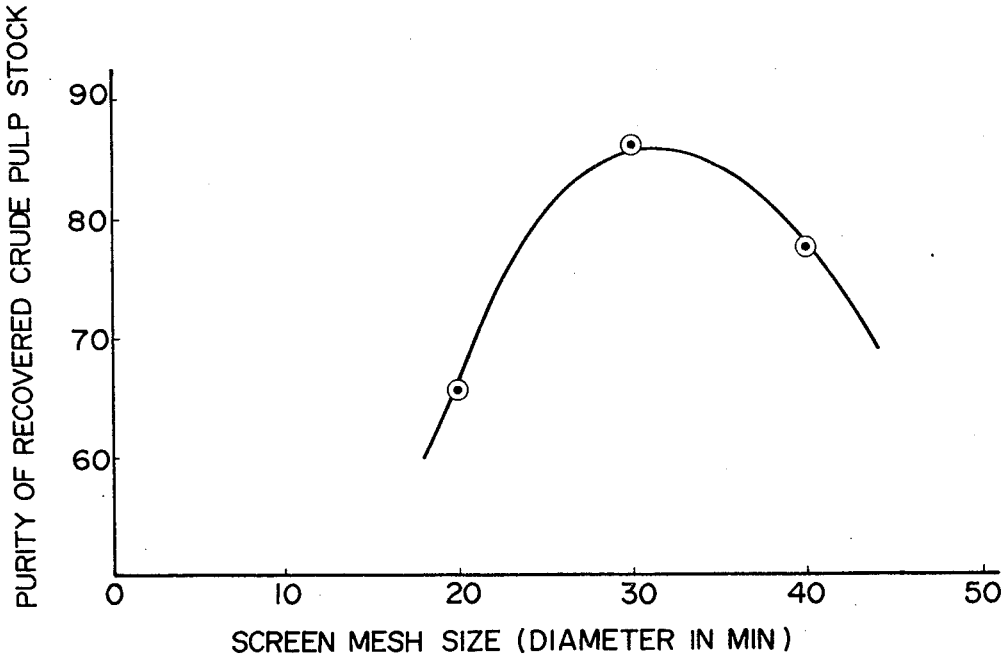
FIG. 14 illustrates the relationship between the quality of the pulp recovered and the diameter of the screen mesh.

This relation and the preferable size may be supported by the test results using the pulverizer illustrated in FIG. 1. The test results are graphically illustrated in FIGS. 12 thru. 14. In FIG. 12, there is illustrated the integrated amount of pulverized garbage against the elapsed time wherein the difference in the clearance is not remarkable while, in FIG. 13 wherein the amount of pulverized waste paper contained in the municipal waste is presented with respect to the elapsed time, the difference in the clearance "$c$" is remarkable. According to the results shown in FIGS. 12 and 13, it is noted that the soft constituents such as garbage are pulverized in a short period by the mixing and agitating effect and, thus, the difference caused by shearing action due to the portions discussed as clearance is not noticeable. At the same time, the constituents having intermediate strength such as waste paper are substantially affected by the shearing action and, thus, the effect of the clearance "$c$" on the time required to pulverize the waste paper is meaningful. The graph shown in FIG. 14 deals with the quality aspect of the recovered crude pulp stock with respect to the mesh size of the cylindrical screen. It is readily noted from this graph that the purity of the crude pulp stock is highest when the diameter of the mesh of the cylindrical screen is approximately 30 mm. When the mesh size is less than 30 mm, the brittle or fragile constituents such as glass and/or trash are not discharged thoroughly and tend to be mixed with the constituents belonging to Gr. II in which most of the waste paper is included, thereby degrading the quality of recovered crude pulp stock. When the mesh size is greater than the value above, the pulverized waste paper tends to be discharged earlier than is desirable and, contrary to this, some portion of Gr. III such as plastics may be mixed and discharged together with the crude pulp stock recovered, thereby, also, degrading the quality. Therefore, in order to maintain the purity of the recoverd pulp stock in the commercially practicable range of 75 – 80%, the mesh size of the cylindrical screen is selected to be between 20 mm and 45 mm and preferably between 23 mm and 40 mm.

With of the pulverizer 20' illustrated in FIG. 3, the clearance is identified as "$c_1$" in the first stage and as "$c_2$" in the second stage. In such a two stage pulverizer as shown in FIGS. 3, 4 and 5, it is preferable to determine the relationship between the mesh size and the clearance by the following formula, i.e.

$c_1 > 0.7d > c_2$

According to FIG. 12, if the dwell time of the waste in the first stage is assumed to be 1.5 minutes, approximately 93% of the garbage is discharged under the relationship above. Within the above dwell time, approximately 30% of the waste paper is pulverized and admixed with the above discharged garbage according to FIG. 13. If the relationship is set to be $c_1 = c_2 < 0.7d$, 93% garbage will be discharged within 1 minute; however, during this period, approximately 53% of the waste paper is also discharged together with the garbage, thereby reducing the recovery rate of the crude pulp stock obtained in the second stage. Also, if the relationship $c_1 = c_2 > 0.7d$ is established, the pulverizing efficiency in the second stage is reduced. Therefore, the relationship set forth above, i.e.

$c_1 > 0.7d > c_2$ is preferable.

Now the relative rotational speed will be discussed. In a single stage type or the first stage of the two stage pulverizer, the relative rotational speed between the cylindrical screen and the tips of the beater is most preferably in the range of 1 – 3 m/sec. If a value lower than the above is selected, the garbage and other constituents belonging to Gr. I will not be completely pulverized, but will be included into Gr. II, and if a value outside the upper limit of the range above is selected, the waste paper or the like is pulverized and discharged in the first stage and, thus, the recovery rate of the crude pulp stock becomes lower.

Regarding the relative rotational speed in the second stage of the two stage pulverizer, the range of 3 – 6 m/sec. is preferable. If a value lower than the above is selected, the waste paper is not pulverized enough and some portion will be transported to be mixed with Gr. III; if a value higher than the upper limit of the range above is selected, some part of Gr. III will be pulverized and discharged in the second stage.

Further, the rotational speed of the cylindrical screen is preferably set to be $$\frac{20 \sim 40}{\sqrt{D}} \text{r.p.m.}$$

wherein D is the inside diameter of the cylindrical screen in meters. By employing this preferred range, pulverization is effectively performed so as to increase the processing capacity as well as to effectively prevent clogging of the screen mesh under the agitation and beating of the waste by the combination of beaters and centrifugal force of the rotating screen.

An example of the operating effect for pulverizing and segregating the municipal waste according to the present invention is presented below.

A test was conducted using the two stage pulverizer according to the present invention.

The waste charged into the pulverizer was selected to have the constituents noted in Table I below.

Table I

| | | |
|---|---|---|
| Combustible Constituents | | |
| Waste Paper | | 38.2% |
| Plastics | | 7.3% |
| Textile | | 3.6% |
| Wood & Bamboo | | 4.2% |
| Rubber & Leather | | 0.5% |
| Garbage | | 22.7% |
| Others | | 5.7% |
| | Sub-total: | 82.2% |
| Non-Combustible Constituents | | |
| Metallic | | 4.1% |
| Glass & Ceramic | | 7.1% |
| Others | | 6.6% |
| | Sub-total: | 17.8% |

The composition above resembles a typical one as reported by the Tokyo Municipal Office in 1972. The results of sorting or segregation are presented below in Tables II and III.

Table II (%: Dry Base)
Comparison between the Groups

| | Gr. I | Gr. II | Gr. III | Total |
|---|---|---|---|---|
| Paper | 20.0 | 59.0 | 20.4 | 100 |
| Garbage | 94.6 | 5.4 | 0 | 100 |
| Glass | 100 | 0 | 0 | 100 |
| Pebble and Sand | 96.4 | 3.6 | 0 | 100 |
| Metal | 0 | 0 | 100 | 100 |
| Plastics, Rubber, Leather | 11.5 | 10.1 | 78.4 | 100 |
| Textile | 0 | 0 | 100 | 100 |
| Wood, Bamboo | 2.3 | 42.8 | 54.9 | 100 |

Table III (%: Dry Base)
Comparison within Each Group

| | Gr. I | Gr. II | Gr. III |
|---|---|---|---|
| Paper | 23.0 | 85.2 | 27.4 |
| Garbage | 12.0 | 0.9 | 0 |
| Glass | 40.8 | 0 | 0 |
| Pebble and Sand | 20.4 | 1.0 | 0 |
| Metal | 0 | 0 | 22.4 |

Table III-continued (%: Dry Base)
Comparison within Each Group

| | Gr. I | Gr. II | Gr. III |
|---|---|---|---|
| Plastics, Rubber, Leather | 3.8 | 4.2 | 30.7 |
| Textile | 0 | 0 | 8.6 |
| Wood, Bamboo | 0.4 | 8.8 | 10.9 |
| Total: | 100 | 100 | 100 |

According to Tables II and III, the following points are noted. a. Over approximately 90% of the garbage and most of the glass and rubbish are segregated into Gr. I. b. Approximately 60% of the waste paper is included in Gr. II and the rest is divided between Gr. I and Gr. III. c. approximately 80% of the plastic waste, over approximately 90% of the metallic waste and most of the textile are sorted into Gr. III.

The necessary power for the test above was noted as under 2 KWh/ton (Wet base).

Figure 15:
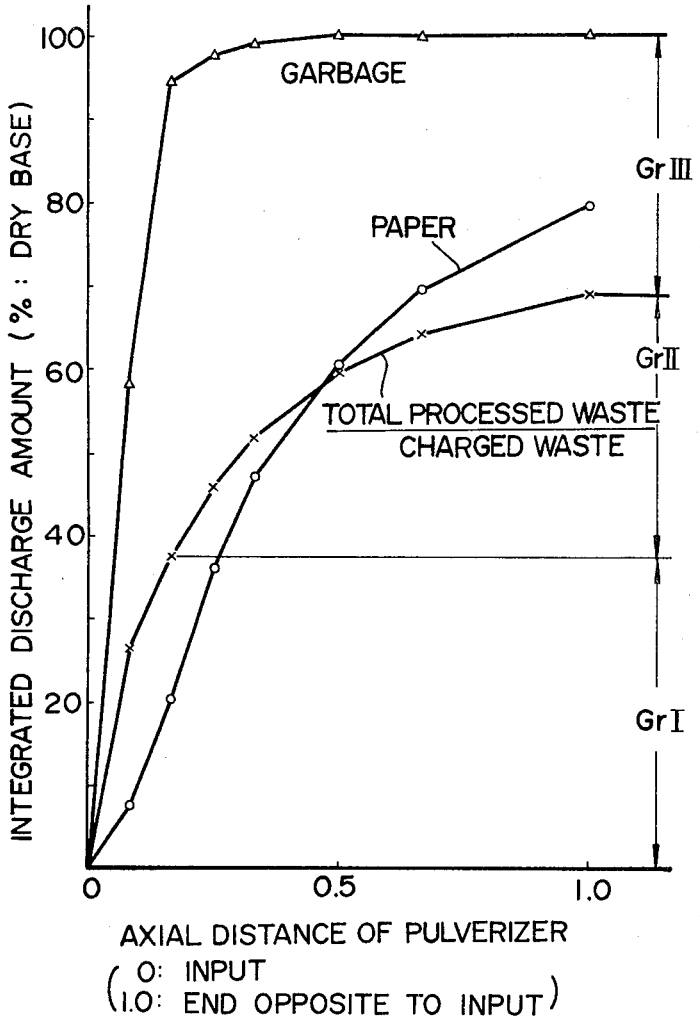
FIG. 15 illustrates the integrated amount of discharge along the axial length of the pulverizer.

To look at the test from another viewpoint, the integrated processed quantity for the certain items in the waste with respect to the axial direction of the pulverizer is plotted and illustrated in FIG. 15.

The further disposition of Gr. I, Gr. II and Gr. III is well known to those skilled in the art; however, to better understand the advantage of the present invention, a brief explanation of this field is summarized below.

The combustible constituents such as garbage and so on included in Gr. I are utilized to generate fuel gas by, for example, a heat-decomposition apparatus of a fluidization system or are incinerated by a furnace of a fluidization system so as to directly use the heat from the incineration. The size of grain discharged as Gr. I is in a preferred range for treating by in a fluidization system. Since the percentage of plastics contained in Gr. I is relatively low, the possibility of generating injurious or noxious material such as HC and/or heavy metal within left-overs of dregs is reduced, and it is rare that the apparatus for such post-treatment is attacked and degraded by generated harmful gas. Gr. I is also suitable for compost treatment.

With respect to glass in Gr. I, it is optional whether to separate it from the rest such as by employing an optical process or to utilize it as a binding agent to fuse and simultaneously solidify other materials such as ceramics, shells, eggshell etc. This solidified waste may be used for landreclamation.

Processes for the recovery of the crude pulp stock from Gr. II, are well known in the art. Since the amount of garbage in Gr. II is relatively low, the water used for treating the recovered crude stock may not cause the value of BOD to become high, thereby avoiding pollution or public nuisance during the post-treatment as well as increasing the recovery rate of the crude pulp stock.

With respect to Gr. III, as illustrated in FIG. 4, this group may be further divided into Gr. III*a* and Gr. III*b* by the sorter 51 which, for example, utilizes the difference in specific gravity between the constituents. Ferrous materials in Gr. III*a* may be magnetically collected. As to re-utilization of Gr. III*b*, several ways may be considered. For example, the pulverized constituents as a whole may be compressed into low grade construction goods such as a pile, picket, or a fish-gathering block by using thermo-plastic materials contained in Gr. III*b* in which the mass of the thermoplastics materials reaches approximately 35% with respect to total mass of Gr. III*b*. Of course, each of the constituents may be independently reutilized or all of them may be heat decompositioned to generate fuel gas or to take out liquid fraction thereof.

The apparatus of the present invention is capable of pulverizing and sorting the municipal waste at one place with increased capacity, thereby making it possible to minimize the installation area and, thus, to reduce the installation cost. Also, the apparatus is easy to maintain due to is construction which, as explained, is substantially trouble-free. The invention has been explained in detail referring to the embodiments thereof; however, the invention is not limited to those explained and modifications and variations are, of course, available within the spirit and scope of the invention claimed.

We claim:

1. An apparatus for size-reducing and sorting waste, said apparatus comprising:

a hollow cylindrical screen;

a plurality of elongated ridge-like projections on the inner surface of said screen;

a rotatable shaft longitudinally fitted through said cylindrical screen;

a plurality of beaters mounted on said shaft for rotation therewith said beaters extending radially from said shaft and opposing said projections inside said cylindrical screen;

anti-entangling means connected to said beaters and said shaft for preventing elongated constituents of waste being treated from entangling about said shaft;

first rotating means connected to said shaft for rotating said shaft within said cylindrical screen; and second rotating means contacting said cylindrical screen for rotating said screen relative to said shaft therethrough.

2. An apparatus as claimed in claim 1, wherein:

said ridge-like projections extend axially along said cylindrical screen.

3. An apparatus as claimed in claim 1, wherein:

said ridge-like projections are inclined with respect to the axis of said shaft through said screen.

4. An apparatus as claimed in claim 1, wherein:

said anti-entangling means is comprised of a plurality of plates attached to said beaters and said shaft, extending axially along said shaft, and extending radially away from said shaft a distance less than the length of said beaters.

5. An apparatus as claimed in claim 1, wherein:

the ends of said beaters directed toward said screens are spaced from said ridge-like projections by a distance not greater than 70% of the diameter of the openings through said screen.

6. An apparatus as claimed in claim 1, wherein:

the openings through said screen have a diameter of 24 – 45 mm.

7. An apparatus for size-reducing and sorting waste, said apparatus comprising:

a hollow first cylindrical screen having inlet and discharge ends;

a plurality of first ridge-like projections fixed to the inner surface of said first screen;

a hollow second cylindrical screen axially aligned with the discharge end of said first screen and having inlet and discharge ends, said inlet end being aligned with the discharge end of said first screen;

a plurality of second ridge-like projections fixed to the inner surface of said second screen;

a rotatable shaft extending longitudinally through said first and second screens;

a plurality of beaters mounted on said shaft for rotation therewith, said beaters extending radially from said shaft and opposing said projections inside said first and second screens;

anti-entangling means connected to said beaters and said shaft for preventing elongated constituents of the waste being treated from entangling about said shaft;

first discharge means beneath said first screen for removing the treated waste passing through the openings in said first screen;

second discharge means beneath said second screen for removing the treated waste passing through the openings in said second screen;

third discharge means at the discharge end of said second screen for removing the waste from said second screen which does not pass through the openings therein;

first rotating means contacting said first and second screens for rotating said first and second screens relative to said shaft therethrough; and second rotating means connected to said shaft for rotating said shaft within said hollow screens.

8. An apparatus as claimed in claim 7, wherein:

said anti-entangling means is comprised of a plurality of plates attached to said beaters and said shaft, extending axially along said shaft, and extending radially away from said shaft a distance less than the length of said beaters.

9. An apparatus as claimed in claim 7, wherein:

the openings through said first screen are smaller than the opening through said second screen.

10. An apparatus as claimed in claim 7, wherein:

said ridge-like projections in said first and second screens extend in the axial direction along said screens.

11. An apparatus as claimed in claim 7, wherein:

said ridge-like projections in said first and second screens are inclined with respect to the axis of said shaft through said screens.

12. An apparatus as claimed in claim 7, wherein:

said first rotating means is comprised of two separate rotating means contacting said first and second screens respectively for rotating each screen independently of the rotation of the other.

13. An apparatus as claimed in claim 7, wherein:

said shaft is comprised of a first shaft portion through said first screen and a second shaft portion connected with said first shaft portion extending through said second screen; and said second rotating means is comprised of two separate rotating means connected to said first and second shaft portions respectively for rotating said first shaft portion independently of the rotation of the second shaft portion.

14. An apparatus as claimed in claim 13, wherein:

said anti-entangling means is comprised of a first plurality of plates attached to said beaters of said first shaft portion, extending axially along said first shaft portion, and extending radially away from said first shaft portion a distance less than the length of said beaters; and a second plurality of plates attached to said beaters of said second shaft portion, extending axially along said second shaft portion, and extending radially away from said second shaft portion a distance less than the length of said beaters.

15. An apparatus as claimed in claim 7, wherein: the ends of said beaters within said first screen directed toward said first projections are spaced from said ridge-like projections by a distance greater than 70% of the diameter of the openings through said first screen; and the ends of said beaters within said second screen directed toward said second projections are spaced from said projections by a distance not greater than 70% of the diameter of the openings through said second screen.

16. An apparatus as claimed in claim 15, wherein: the openings through said second screen have a diameter of 20 – 45 mm.

* * * * *